US006130650A

United States Patent [19]

Curtis et al.

[11] Patent Number: 6,130,650

[45] **Date of Patent: *Oct. 10, 2000**

[54] CURVED INVERTED ANTENNA

[75] Inventors: Alastair Curtis, London; Stephen Goodwin, Surrey, both of United Kingdom

[73] Assignee: Nokia Mobile Phones Limited, Salo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/686,872

[22] Filed: Jul. 26, 1996

[30] Foreign Application Priority Data

Aug. 3, 1995 [GB] United Kingdom ..... 9515958

[51] Int. Cl.[7] ..... H01Q 1/38

[52] U.S. Cl. ..... 343/846; 343/828; 343/830

[58] Field of Search ..... 343/846, 848, 343/829, 830, 705, 827, 828, 795, 825; H01Q 1/36, 1/38

[56] References Cited

U.S. PATENT DOCUMENTS

| | | | |
|---|---|---|---|
| 2,990,546 | 6/1961 | Haas | 343/705 |
| 3,488,657 | 1/1970 | Pressel et al. | 343/705 |
| 3,680,127 | 7/1972 | Richard | 343/830 |
| 3,906,507 | 9/1975 | Allen | 343/705 |
| 4,010,470 | 3/1977 | Jones | 343/708 |
| 4,162,499 | 7/1979 | Jones et al. | 343/708 |
| 4,998,078 | 3/1991 | Hulkko | 333/109 |
| 5,276,920 | 1/1994 | Kuisma | 455/101 |
| 5,341,149 | 8/1994 | Valimaa et al. | 343/895 |
| 5,437,091 | 8/1995 | Norman | 29/600 |

FOREIGN PATENT DOCUMENTS

| | | |
|---|---|---|
| 0394 960 | 10/1990 | European Pat. Off. . |
| 9404083 U | 6/1994 | Germany . |
| 59-097204 | 5/1984 | Japan . |
| WO 93/12559 | 6/1993 | WIPO . |
| WO 95/02284 | 1/1995 | WIPO . |

*Primary Examiner*—Michael C. Wimer
*Attorney, Agent, or Firm*—Perman & Green, LLP

[57] ABSTRACT

A curved inverted-L and F antenna is disclosed. In a preferred embodiment a curved inverted-F antenna 300 comprising a capacitative line 206 and inductive stub 204 is disposed above a correspondingly curved ground plane 308. Preferably, the separation between the capacitative line 206 and ground plane 308 is substantially constant and of the order of one tenth of the wavelength of the operating frequency of the antenna. Suitably the short circuit element of the antenna and the feed track 402 are non-parallel which has the effect of improving the radiated field in a short circuit direction.

11 Claims, 2 Drawing Sheets

CURVED INVERTED ANTENNA

FIELD OF INVENTION

The present invention relates to low profile antennae, particularly but not exclusively to inverted-F antennas.

BACKGROUND OF THE INVENTION

Low profile antennae such as inverted-L or F antennas are well known in the art. An example of an inverted-F antenna is shown in FIG. 1 of the accompanying drawings. The antenna 100 comprises a feed section 102 coupled to a short circuited inductive stub 104 and a capacitative line 106. The inductive stub 104 is short circuited to a ground plane 108, above which the feed section 102 protrudes by a distance D. The ground plane 108 is open to allow access for the feed section 102 which is electrically insulated 110 from the ground plane 108. The respective lengths $L_1$, $L_2$, of the inductive stub 104 and the capacitative line 106 are determined to give a desired resonance frequency and input impedance $Z_{in}$ to the antenna seen from the antenna feed point 112. The input impedance is dependent upon the position of the feed section 102 and hence lengths $L_1$ and $L_2$, and can be made wholly resistive. Typically, this is a 50 OHM impedance in order to match the output or input impedances respectively of commercially available power amplifiers and low noise amplifiers. Further details regarding inverted-L or F antennas may be found in "Small Antennas" ISBN 0 86380 048 3 pages 116–151.

Inverted-F antennas have found particular applications in the radio telephone art where their high gain and omnidirectional radiation patterns are particularly suitable. They are also suitable for applications where good frequency selectivity is required. Additionally, since the antennae are relatively small at typical radio telephone frequencies they can be incorporated within the housing of a radio telephone thereby not interfering with the overall aesthetic appeal of the radio telephone and giving it a more attractive appearance than radio telephones having external antennas. By placing the antenna inside the housing of a radio telephone, the antenna is also less likely to be damaged and therefore have a longer useful life. The inverted-F antenna lends itself to planar fabrication, and may suitably be fabricated on the printed circuit board typically used in a radio telephone to support the electronic circuitry, which lends itself to cheap manufacture.

However, despite their relatively small size the fact that radio telephones are becoming smaller and smaller, and more and more complex necessitating a greater amount of electronics within the housing, the space available for the inverted-F antenna is getting smaller and it is becoming more difficult to conveniently fit such antennae inside the housing. Placing such an antenna external to the housing is inconvenient since it must be conductively coupled through the housing to the components on the printed circuit board, and it removes the benefits normally associated with an internal antenna.

SUMMARY OF THE INVENTION

According to the present invention, there is provided an antenna, comprising a ground plane, a first conductive member disposed transverse to and electrically insulated from the ground plane, and a second conductive member electrically coupled to the first conductive member and having an open circuit end, wherein the second member is concave towards the ground plane.

This has an advantage in that the antenna is smaller than conventional inverted-L or F antennas and is therefore suitable as an internal antenna for apparatus which has little available space inside.

In a preferred embodiment of the invention the ground plane is correspondingly curved with respect to the second member. This has a surprising and unexpected advantage in that the radiation pattern is improved over that obtained with a flat ground plane and is similar to that from a conventional inverted-L or F antenna. Additionally, the amount of power radiated from the open circuit end is increased relative to that obtained with a flat ground plane antenna.

Preferably, the separation between the second member and the ground plane is substantially constant, and suitably the separation between the second member and the ground plane is of the order of one tenth of the wavelength of the centre frequency of the antenna.

Advantageously, the second conductive member comprises a stub portion electrically coupled to ground and extending to a side of the first member in an opposing direction to the open circuit end. This results in the possibility of tuning out the respective reactances of the short circuited stub and open circuit end such that the antenna has a wholly resistive input impedance. When combined with the feature of a curved ground plane there is the advantage that the characteristic impedance of the antenna is independent of the open circuit length and hence it is easier to match the input impedance to the output impedance of conventional electronic devices, by locating the antenna feed at an appropriate point from the short circuited stub and open circuit end.

Typically the ground connection for the stub portion comprises a conductive element contacting the ground plane, and the first member, conductive element and open circuit end are substantially in line.

By arranging the first member and conductive element such that they are non-parallel the respective currents flowing in opposite directions in the first member and conductive element tend not to cancel in the far radiative field. Consequently, a greater radiated field is possible in a short circuit direction of the antenna than can be achieved with a conventional inverted-F antenna.

The antenna may be fabricated on a suitable substrate such as a printed circuit board, and the ground plane may be formed from a part of the radio frequency shielding for circuitry associated with an apparatus associated with the antenna.

DETAILED DESCRIPTION OF EMBODIMENTS OF THE INVENTION

Embodiments of the invention will now be described, by way of example only, and with reference to the accompanying drawings.

Figure 1:
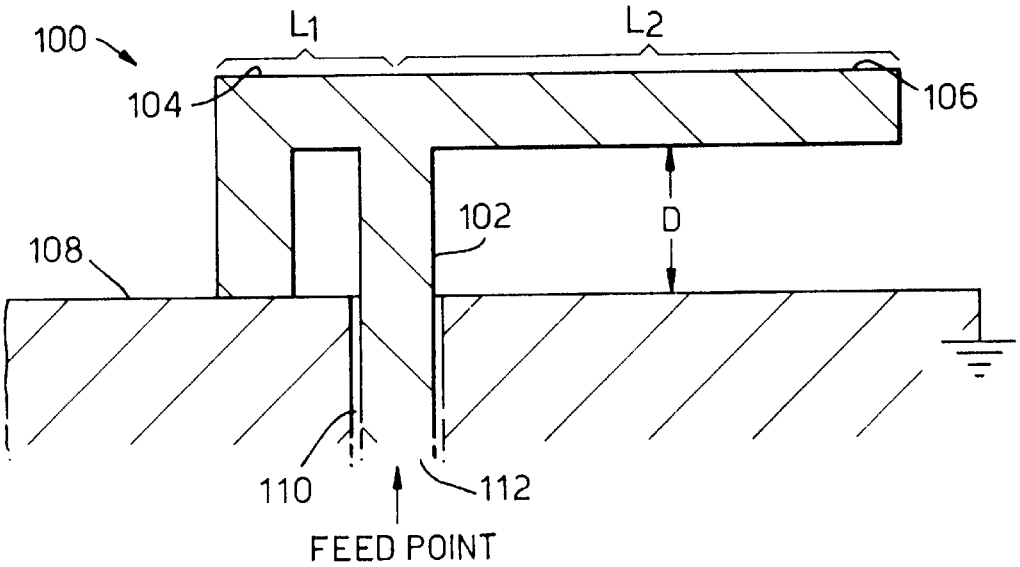
FIG. 1 is a schematic diagram of a conventional inverted-F antenna.
Figure 2:
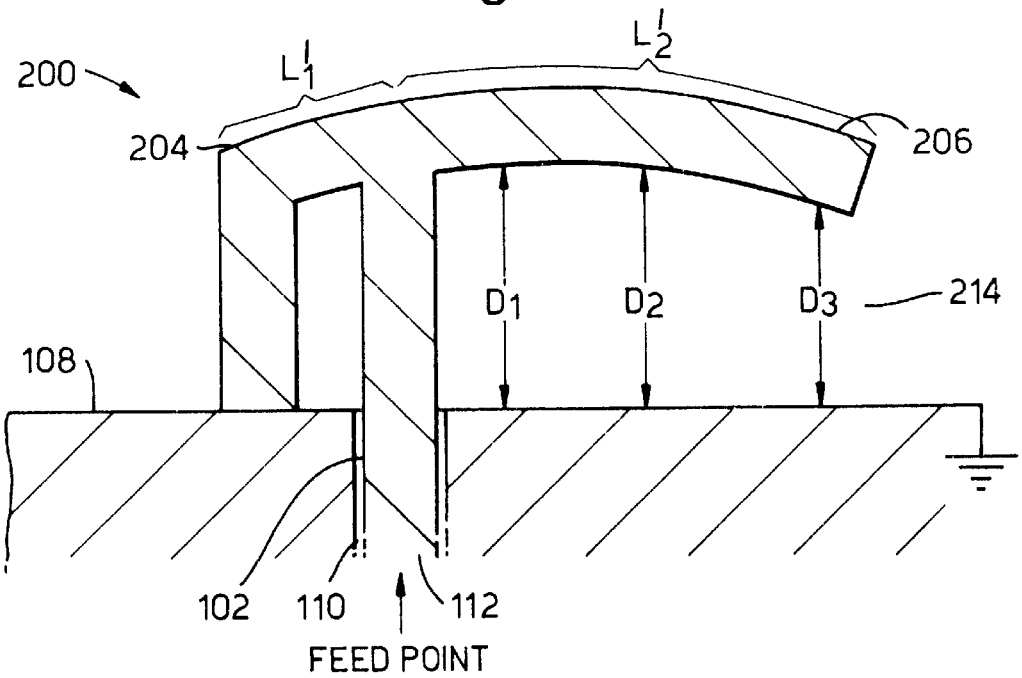
(PRIOR ART) Fig.2.
FIG. 2 is a schematic diagram of a curved inverted-F antenna in accordance with a first embodiment of the invention.

FIG. 2 shows a schematic diagram of an antenna, named curved inverted-F antenna, in accordance with a first embodiment of the invention. When referring to FIG. 2 like features to features in FIG. 1 will be referred to by like reference numerals for FIG. 1. The inductive stub 104 and capacitative line 106 of FIG. 1 are now curved inductive stub 204 and curved capacitative line 206. The amount of space taken up by the curved inverted-F antenna along its longtitudinal axis is substantially less than that taken up by the conventional inverted-F antenna. Thus, the curved inverted-F antenna can fit into smaller spaces. As can be seen from FIG. 2, the distance between the curved inductive stub 204 and curved capacitative line 206, and the ground plane varies, for example having distances $D_1$, $D_2$ and $D_3$. Since the curved inductive stub 204 is relatively short compared to the curved capacitative line 206, the effects of the curvature on the inductive stub 204 can be ignored. However, it is the Applicant's understanding that such effects cannot be ignored with regard to the curved capacitative line 206. The effect of the curvature is to give an effective characteristic impedance $Z_0$ which is dependent upon the length $L'_2$ of the curved capacitative line 206. In terms of transmission line equations, this has the effect of providing an input impedance of the form, $$Z_{i_n} = \frac{-jZ_o(L_{2'})}{\tan\beta L_{2'}}$$

where $Z_{in}$ is the input impedance seen at the feed point to the antenna, $Z_0$ ($L'_2$) is the length dependent effective characteristic impedance of the capacitative line, $L'_2$ is the length of the capacitative line and β is the phase of a signal propagating down the curved capacitative line 206. The dependence of the input impedance on two parameters which are functions of the length $L'_2$ of the curved capacitative line 206 makes the calculations for matching the antenna to a desired feed point impedance difficult, and further may have the effect of reducing the band-width of the antenna. Additionally, the open end 214 of the curved capacitative line 206 is closer to the ground plane 108 than the rest of the antenna and has the effect of closing off a radiating aperture of the antenna compared with the conventional inverted-F antenna. This has a detrimental effect on the radiation patterns of the antenna.

Figure 3:
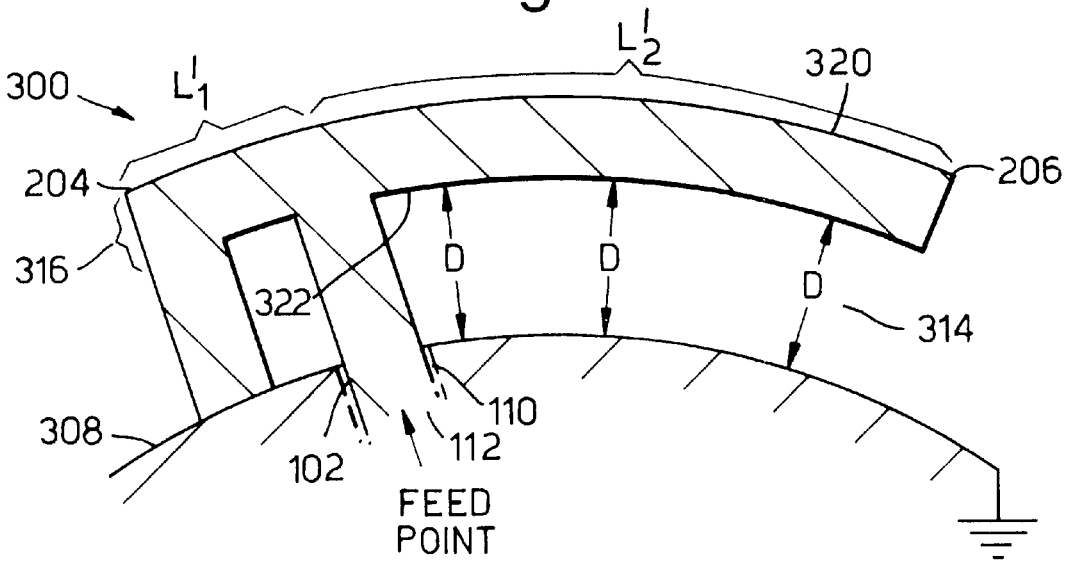
FIG. 3 is a schematic diagram of a curved inverted-F antenna with a curved ground plane in accordance with a second embodiment of the invention.

A preferred embodiment of the invention is shown schematically in FIG. 3 where like features to those in FIGS. 1 and 2 are described using like reference numerals. In the preferred embodiment the ground plane 308 for the curved inverted-F antenna is correspondingly curved such that the distance D between the curved capacitative line 206 and the ground plane 308 remains substantially constant. This has the effect of removing the dual dependency of the input impedance on the length $L'_2$ of the curved capacitative line 206, and further maintaining the open end 314 of the curved capacitative line 206 at the greatest separation D from the ground plane 308. Thereby, giving good radiation from the open end 314 such that it is substantially similar to that obtainable from a conventional inverted-F antenna.

Figure 4:
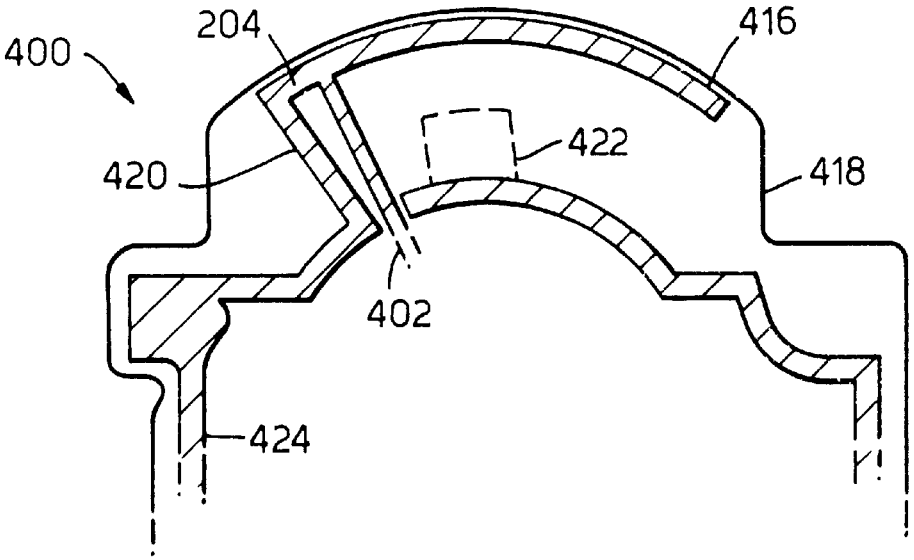
FIG. 4 is a schematic diagram of an embodiment of the invention showing a curved inverted-F antenna disposed on a printed circuit board and coupled to a ground conductor of the printed circuit board.

In the preferred embodiment of the invention the curved inverted-F antenna 416 is built on a printed circuit board 418 as shown in FIG. 4. The antenna is designed to operate at a centre frequency of 1890 MHz in a frequency band of 1880 to 1900 MHz, and requires a bandwidth of at least one per cent of the centre frequency (1890 MHz). The design parameters of the antenna 416 in accordance with the preferred embodiment of the invention are such that the width 316 of the curved inductive stub 204 and curved capacitative line 206 is 2 mm. The thickness of the feed track 102 is 1 mm and the distance D between the inside edge 322 of the antenna and the ground plane 308 is approximately one-tenth of the centre frequency wavelength, that is to say 8 mm. The radius of curvature 320 of the outer edge of the antenna is 24.7 mm, and the radius of curvature of the inner edge 322 of the antenna is 22.7 mm. The radius of curvature of the ground plane is 13 mm. The curved inverted-F antenna 416 is built on a printed circuit board made of any suitable material using conventional copper metalisation.

In the preferred embodiment, and as shown in FIG. 4, the feed track 402 is not parallel to the short circuit 420 for the curved inductive stub 204, but instead each follow their respective radiuses. This has the effect that the current flowing in the feed track 402 and short circuit 420 are not parallel. Thus, even though the currents flow in opposite directions, unlike the conventional inverted-F antenna and the curved inverted-F antenna shown in FIGS. 2 and 3 these current contributions tend not to cancel in the far field region of the radiation patterns. Consequently, a curved inverted-F antenna in accordance with the embodiment shown in FIG. 4 has greater radiated power in its short circuit direction than obtainable from a conventional inverted-F antennae. In practical applications of the present invention, it is necessary to provide testing contacts 422 on the printed circuit board 418 so that the performance of the antenna may be tested during manufacture. Such a testing contact is of course conductive and may act to perturb the performance of the antenna if it is too large. However, the Applicant has found that small perturbations such as that shown in FIG. 4 as reference 422 do not unduly affect the performance of the antenna and can be tolerated. As can be seen in FIG. 4, the curved inductive stub 204 is grounded to a ground conductor 424. This ground conductor 424 may form part of the ground conductor for the RF shielding of the radio telephone and consequently is a convenient ground connection for the curved inductive stub 204. Optionally, a radio frequency shield or cover may form the ground plane and ground connection for the curved inductive stub 204. This may be particularly useful should the curved inverted-F be fabricated on the interior of the housing of the radio telephone such that the conductive housing of the RF shield provides its ground plane.

The amount of curvature of the antenna, and correspondingly the ground plane, is in part determined by the radiation patterns the antenna is desired to generate. The Applicant is not aware of any limitations on the curvature due to impedance matching criteria.

In view of the foregoing description it will be evident to a person skilled in the art that various modifications may be made within the scope of the invention.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

What is claimed is:

1. An antenna comprising coplanar conductive traces disposed on a planar substrate surface:

a first conductive trace defining a ground region;

a second conductive feed trace defining a first element, which extends transversely through said first trace, said second trace being insulated from said ground region where said second trace passes through said first trace; and a third conductive trace defining a curved second element, connected to said first element at a first end, and having a second open circuit end, wherein said second element extends to one side of said first element and a distance between said second element and said ground region remains constant as the distance from said first element increases.

2. An antenna according to claim 1, wherein a separation between the third conductive trace and the ground region exists and is of the order of one tenth of the wavelength of the center frequency of the antenna.

3. An antenna according to claim 1, and fabricated on a printed circuit board.

4. An antenna comprising coplanar conductive traces disposed on a planar substrate surface:

a first conductive trace defining a ground region;

a second conductive feed trace defining a first element, which extends transversely through said first trace, said second trace being insulated from said ground region where said second trace passes through said first trace; and a third conductive trace defining a curved second element, connected to said first element at a first end, and having a second open circuit end, wherein said second element extends to one side of said first element and a distance between said second element and said ground region decreases as the distance from said first element increases.

5. An antenna according to claim 4, and fabricated on a printed circuit board.

6. An antenna comprising coplanar conductive traces disposed on a planar substrate surface:

a first conductive trace defining a ground region;

a second conductive feed trace defining a first element, which extends transversely through said first trace, said second trace being insulated from said ground region where said second trace passes through said first trace; and a third conductive trace defining a curved second element, connected to said first element at a first end, and having a second open circuit end, wherein said second element extends to one side of said first element and a distance between said second element and said ground region remains constant as the distance from said first element increases and a fourth conductive trace defining a stub element connected at a first end to said ground region and at a second end to said first element on an opposing side of said first element to said second element.

7. An antenna according to claim 6, wherein a separation between the third conductive trace and the ground region exists and is of the order of one tenth of the wavelength of the center frequency of the antenna.

8. An antenna according to claim 7, and fabricated on a printed circuit board.

9. An antenna comprising coplanar conductive traces disposed on a planar substrate surface:

a first conductive trace defining a ground region;

a second conductive feed trace defining a first element, which extends through said first trace, said second trace being insulated from said ground region where said second trace passes through said first trace; and a third conductive trace defining a curved second element, connected to said first element at a first end, and having a second open circuit end, wherein said second element extends to one side of said first element and a distance between said second element and said ground region decreases as the distance from said first element increases, and a fourth conductive trace defining a stub element connected at a first end to said ground region and at a second end to said first element on an opposing side of said first element to said second element.

10. An antenna according to claim 9, and fabricated on a printed circuit board.

11. An antenna according to claim 9 wherein said second trace and said fourth trace are not parallel to each other.

* * * * *